United States Patent [19]

Hinch et al.

[11] 4,241,680

[45] Dec. 30, 1980

[54] DEVICE FOR STOPPING A NEEDLE AT A PREDETERMINED POSITION

[75] Inventors: Peter G. Hinch, Rusholme; Kenneth F. Hall; George Chambers, both of Martock, all of England

[73] Assignee: Newroyd Limited, Oldham, England

[21] Appl. No.: 890,384

[22] Filed: Mar. 27, 1978

[30] Foreign Application Priority Data

Mar. 31, 1977 [GB] United Kingdom ..... 13652/77

[51] Int. Cl.[3] ..... D05B 69/22

[52] U.S. Cl. ..... 112/275; 112/79 A; 112/221

[58] Field of Search ..... 66/219; 112/275, 277, 112/221, 274, 276, 220, 79 A, 266.2, 67, 87

[56] References Cited

U.S. PATENT DOCUMENTS

| | | | |
|---|---|---|---|
| 579,511 | 3/1897 | Biggar | 112/220 |
| 2,232,692 | 2/1941 | Diehl | 112/221 |
| 2,690,724 | 10/1954 | Eisenbeiss | 112/277 X |
| 2,768,593 | 10/1956 | Lombard | 112/221 |
| 2,921,547 | 1/1960 | Artzt et al. | 112/275 |
| 3,382,829 | 5/1968 | Winberg | 112/275 |
| 3,442,234 | 5/1969 | Cash | 112/274 X |
| 3,564,376 | 2/1971 | Mais et al. | 112/275 X |
| 3,788,250 | 1/1974 | Soeda | 112/275 |
| 3,861,173 | 1/1975 | Kinkelin | 66/50 R |
| 3,863,465 | 2/1975 | De Cerjat et al. | 66/50 R |
| 4,013,933 | 3/1977 | Dohi et al. | 112/275 |

*Primary Examiner*—Werner H. Schroeder
*Assistant Examiner*—Andrew M. Falik
*Attorney, Agent, or Firm*—Anthony J. Casella

[57] ABSTRACT

This invention concerns a machine for making a textile product comprising a needle carrier shaft, reciprocation means for reciprocating said shaft, yarn feeding means for feeding yarn to a needle carried by said shaft, and control means for ensuring that the needle carrier shaft can be stopped only at an end of its reciprocation.

3 Claims, 5 Drawing Figures

DEVICE FOR STOPPING A NEEDLE AT A PREDETERMINED POSITION

Figure 1:
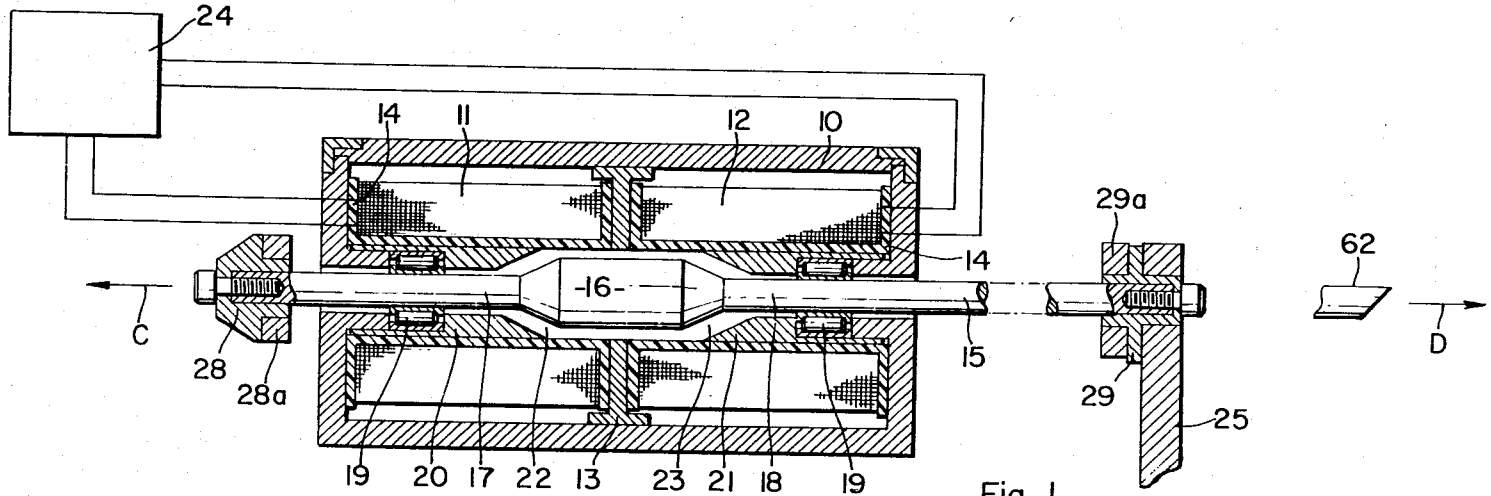

This invention concerns a method and machine for making a textile product and, although the invention is not so restricted, it is more particularly concerned with a method and a machine for making a tufted fabric such, for example, as a tufted carpet or rug.

Machines previously known for producing tufted fabrics have been provided with a machine head having a multiplicity of tufting needles. The tufting needles have been reciprocated into an out of a base material to apply yarn thereto, relative movement being effected between the machine head and the base material in the plane of the latter.

The means which have been employed for effecting such reciprocation of the needles, however, have been such that it has not been possible to ensure that the needles were fully retracted from the base material at the beginning and at the end of the said relative movement. As a result, the first and last stitches effected during the said relative movement did not necessarily pass properly through the base material and therefore were liable to be of poor quality.

According to the present invention, there is provided a machine for making a textile product comprising a needle carrier shaft, reciprocation means for reciprocating said shaft, yarn feeding means for feeding a yarn or yarns to a needle carried by or integral with said shaft, and control means for ensuring that the needle carrier shaft can be stopped only at an end of its reciprocation.

Preferably, the reciprocation means comprises a magnetically permeable core member which is mounted for reciprocating movement and which is drivingly connected to said shaft to effect reciprocation of the latter, and two electromagnetic devices which are respectively disposed on opposite sides of the core member, the said control means effecting alternate energisation of the electromagnetic devices.

The control means preferably comprises an electrical device which, on receiving a stop signal, permits reciprocation of the needle carrier shaft to continue until the latter is at the said end of its reciprocation when a holding current is passed to the respective electromagnetic device to hold the needle carrier shaft at the said end of its reciprocation.

The control means may be adjustable to alter the frequency of the reciprocation of the needle carrier shaft.

The control means may ensure that the rate of change of frequency of reciprocation of the said shaft is controlled to a predetermined value.

The needle carrier shaft is preferably arranged to be set in a plurality of predetermined angular positions, there being provided a control device which is arranged to be programmed to rotate the said needle carrier shaft to the said predetermined angular positions.

The invention also comprises a method of making a textile product comprising feeding a yarn or yarns to a needle carried by or integral with a needle carrier shaft, disposing a base material adjacent to said needle, causing the needle to be reciprocated into and out of the base material so as to apply the yarn or yarns thereto, effecting relative movement between the needle and the base material in the plane of the latter, stopping the reciprocation of the needle at predetermined times, and ensuring that the needle is so stopped only at an end of its reciprocation when it is fully retracted from the base material.

The direction of the said relative movement may be changed at predetermined times, and, at each such change of direction, the needle carrier shaft may be rotated so that a predetermined portion of the needle always faces forwardly, the needle being fully retracted from the base material at the beginning and at the end of the said relative movement.

The needle is preferably reciprocated into and out of the base material, at the beginning and at the end of the said relative movement, at a speed which is lower than a speed of reciprocation which the needle is given between the said beginning and end.

Figure 2:
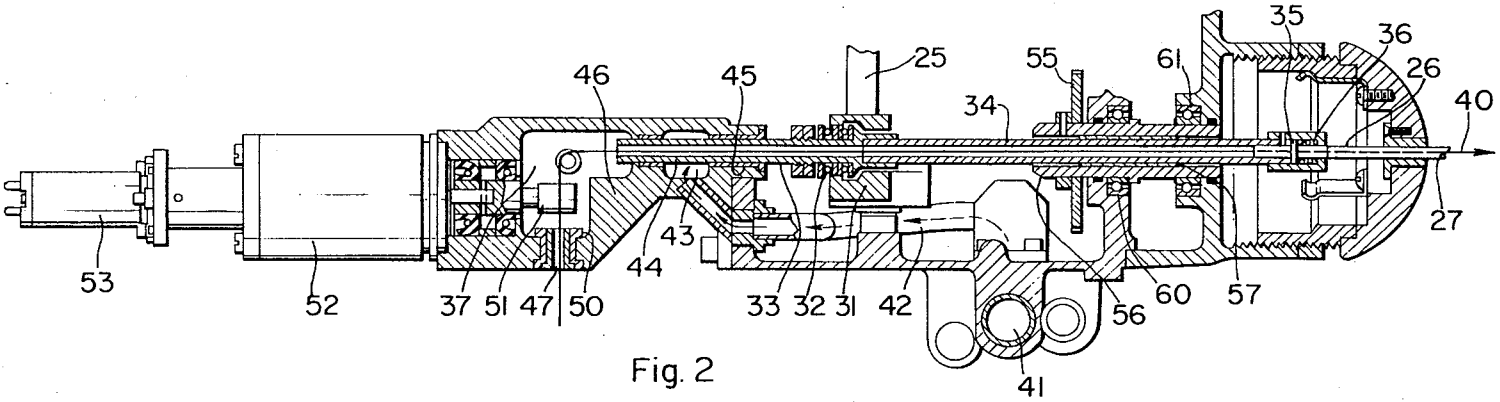
Figure 3:
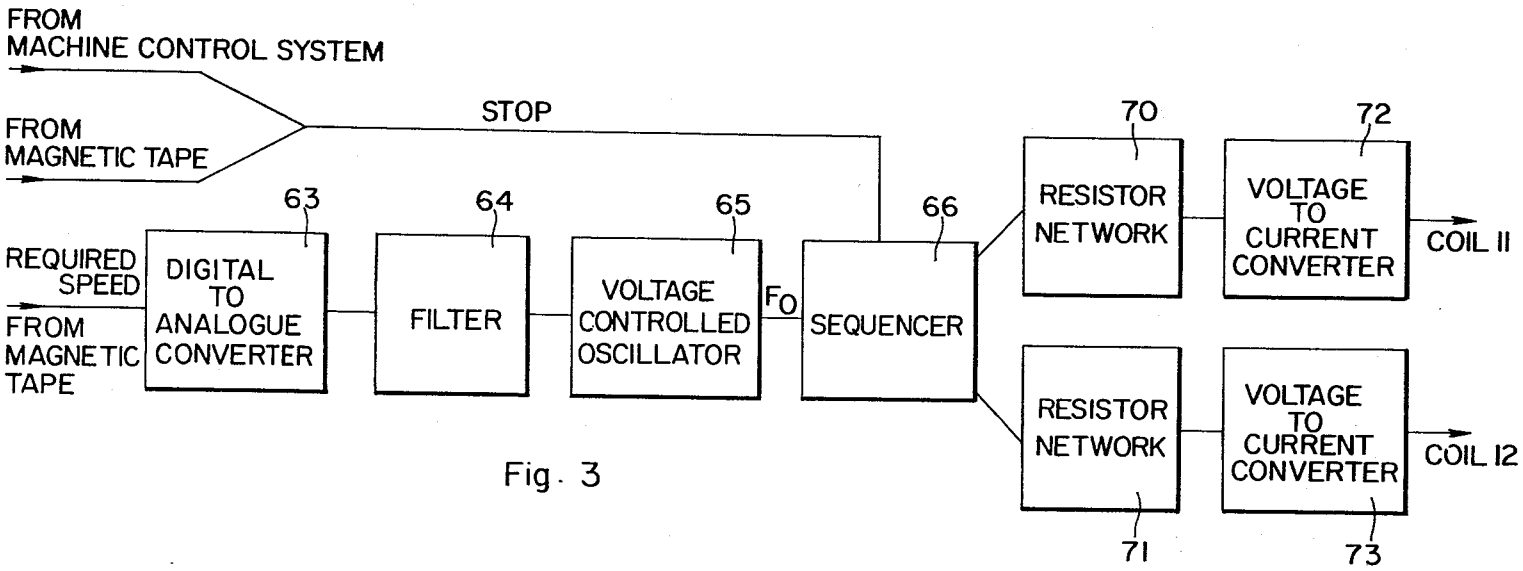
Figure 4:
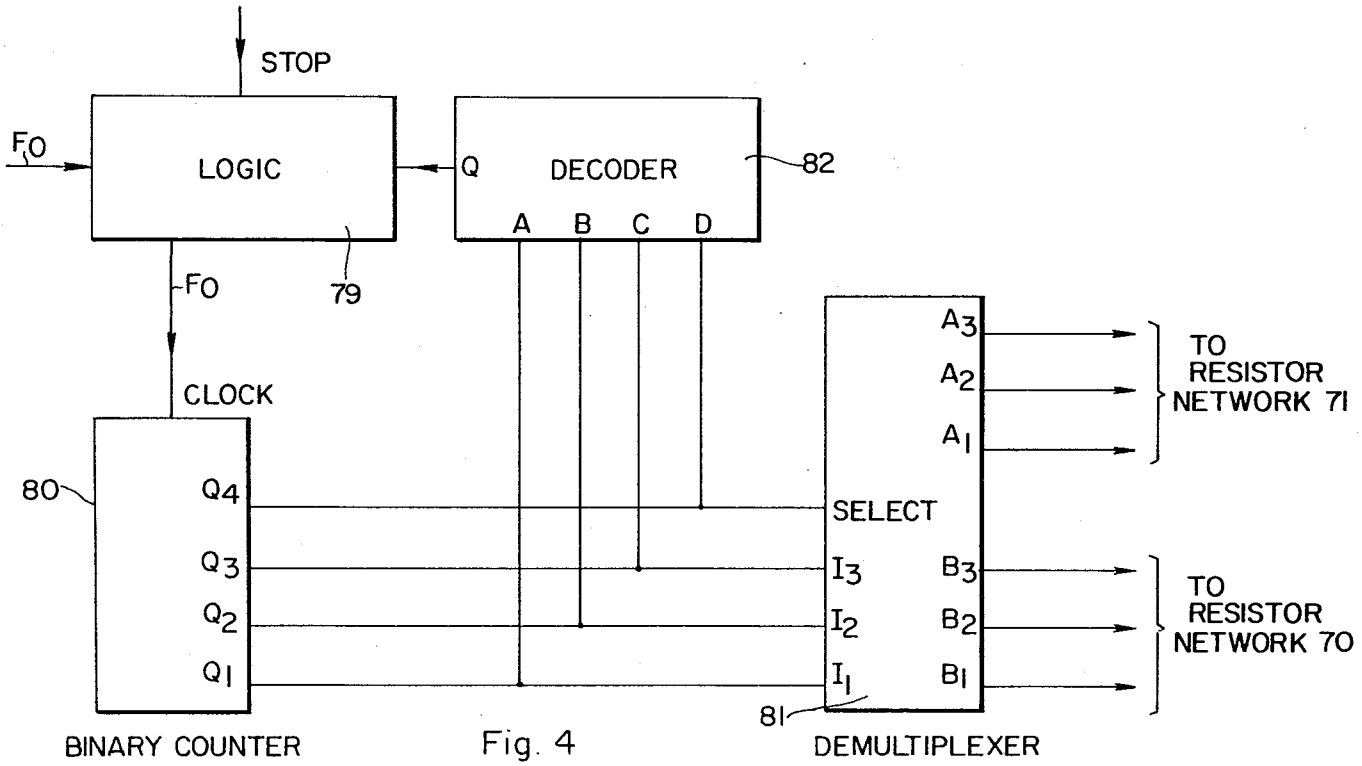
Figure 5:
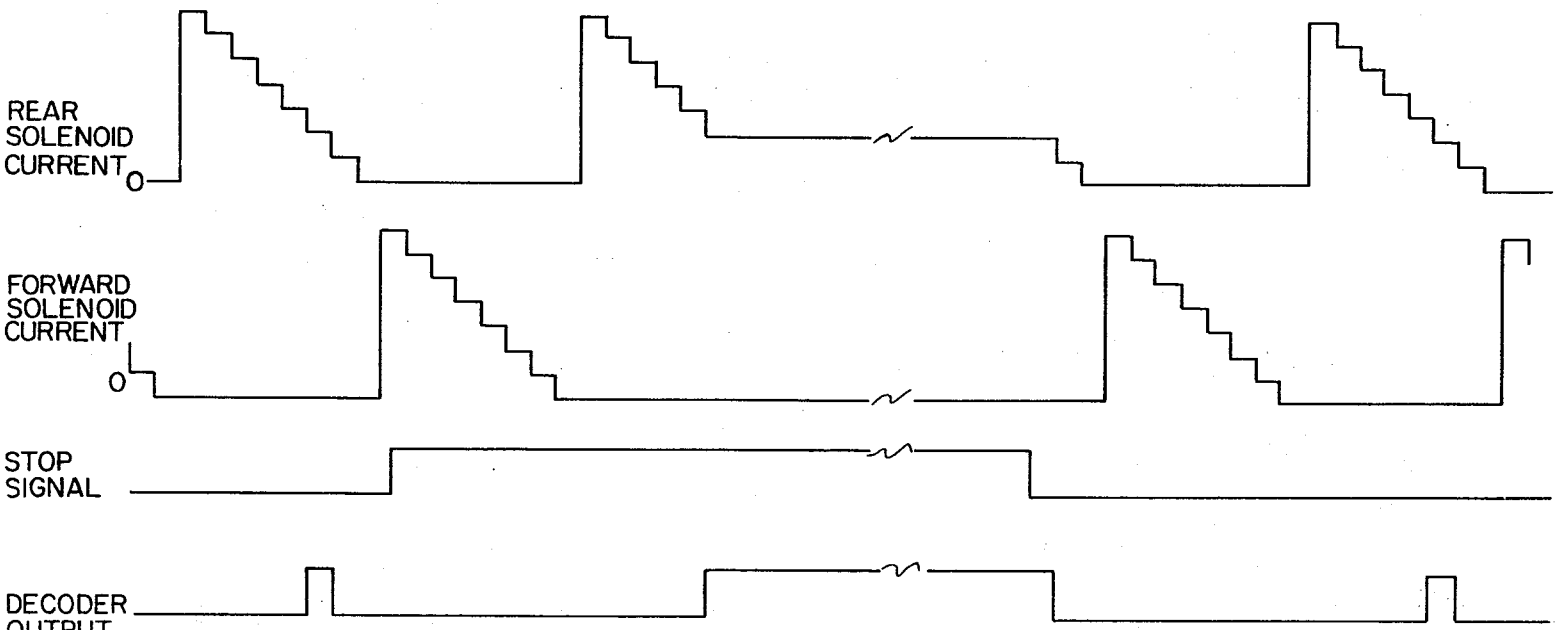

The invention is illustrated, merely by way of example, in the accompanying drawings, in which:

FIG. 1 is a cross-sectional view of part of a machine for making a textile product according to the present invention, FIG. 2 is a cross-sectional view of another part of the said machine, FIG. 3 is a circuit diagram of an electrical control device, FIG. 4 is a circuit diagram of a sequencer forming part of the electrical control device of FIG. 3, and FIG. 5 is a waveform diagram illustrating the operation of the said sequencer.

Terms such as "left" and "right", as used in the description below, are to be understood to refer to directions as seen in the accompanying drawings.

Referring first to FIG. 1, a frame or housing 10 of magnetically permeable material houses a rear solenoid coil 11 and a forward solenoid coil 12. The coils 11, 12 are respectively disposed on opposite sides of a magnetically permeable annular wall member 13 which is mounted concentrically in the frame 10. Although the wall member 13 is shown in FIG. 1 in a central position in the frame 10 this is not necessary since coils 11, 12 of different dimensions may be used if desired. Each of the coils 11, 12 is wound about a non-magnetic bobbin 14.

A shaft 15 has portion constituted by a magnetically permeable core member 16 secured to and disposed between shaft members 17, 18. The shaft members 17, 18 are made of non-magnetic material and are respectively mounted radially inwardly of the coils 11, 12. The shaft 15 passes through the frame 10 and is rotatably mounted in non-magnetic bearings 19 mounted within the frame 10.

When the core member 16 is in a central position, as shown in FIG. 1, the core member 16 is separated from the adjacent magnetically permeable annular parts 20, 21 of the frame 10 by air gaps 22, 23 respectively. The shaft members 17, 18 respectively extend through the parts 20, 21, the parts 20, 21 constituting stator members which are surrounded by and arranged to be magnetised by the coils 11, 12 respectively.

An electrical control device 24 is provided for effecting alternate energisation of the coils 11, 12, the device 24 including means for adjusting the frequency of the said alternate energisation. Alternatively, the coils 11, 12 may be alternately energised by respective electrical devices (not shown).

The shaft members 17, 18 are respectively provided with buffer end stops 28, 29. The buffer end stops 28, 29 are respectively provided with impact absorbing members 28*a*, 29*a* each of which is engageable with a fixed buffer (not shown).

When a voltage is applied to the rear solenoid coil 11, the forward solenoid coil 12 being de-energised at this time, a magnetic field is generated in the surrounding frame 10 which causes the core member 16, and hence the shaft 15, to move in the direction of arrow C so as to reduce the size of the air gap 22. When the voltage to the rear solenoid coil 11 is cut off and a voltage is applied to the forward solenoid coil 12, the core member 16, and hence the shaft 15, will move in the direction of arrow D so as to reduce the size of the air gap 23. Thus the shaft 15 can be reciprocated by alternately energising the coils 11, 12, while the limits of the reciprocation are exactly defined by the abutment between the impact absorbing members 28*a*, 29*a* and the said fixed buffers at opposite ends of the stroke of the core member 16.

The shaft 15, which is thus reciprocated by a solenoid drive, is connected by a rod 25 to a pusher member 31 (see FIG. 2). The pusher member 31 carries a thrust bearing 32 in which is rotatably mounted a hollow shaft 33, the hollow shaft 33 being coaxial with and secured to a hollow needle carrier shaft 34. The left hand end of a hollow needle 26 is mounted in the hollow shaft 34, the needle 26 having a flange 35 which is urged by a spring 36 into the driving contact with the right hand end of the hollow shaft 34. Thus reciprocation of the shaft 15 produces reciprocation of the needle 26 so that tufting yarn 40, which has been fed, by means described below, to a pointed leading end 27 of the needle 26, may be passed through base material (not shown) to produce tufts therein.

Yarn feed air, from a compressed air source (not shown) is supplied to a conduit 41 and passes thence via a conduit 42 to a chamber 43 through which the hollow shaft 33 passes. The wall of the hollow shaft 33 is provided with an aperture 44 therethrough which, when the parts are disposed as shown in FIG. 2, establishes communication between the chamber 43 and the interior of the hollow shaft 33. Thus, in operation, air will pass from the chamber 43 to the interior of the hollow shaft 33 except when, during each reciprocation of the hollow shaft 33, it moves to the left of the position shown, when the aperture 44 will be sealed by a bush 45 mounted in a machine frame 46 within which the hollow shaft 33 is mounted. Thus the air to the interior of the hollow shaft 33 is shut off throughout at least a portion of the time during which the needle 26 does not extend through the base material.

The machine frame 46 is mounted in a machine head (not shown) which is movable in two orthogonal linear directions over the said base material by a traversing mechanism, e.g. as shown in the co-pending U.S. Pat. application Ser. No. 772,839 of William J. Barnes et al, filed Feb. 28th, 1977, U.S. Pat. No. 4,109,593.

Alternatively, at the head, instead of being driven over the base material by a traversing mechanism, could be moved by hand thereover. In this case, the head is provided with control means (not shown) which are arranged to be programmed to rotate the needle to predetermined angular positions, the control means being responsive to the direction in which the head is being moved over the base material.

The yarn 40 passes through a narrow opening 47 in a thread inlet member 50 mounted in the frame 46, the width of the narrow opening 47 being designed to admit the yarn 40 but to minimize air loss therethrough. The yarn 40 passes through the nip between a serrated yarn feed roller 51 and another roller (not shown), both rollers being mounted in a chamber 37. The yarn passes thence successively through the hollow shafts 33, 34 and through the hollow needle 26 and thus out through the pointed leading end 27 of the latter, the yarn being in operation propelled therethrough by the flow of compressed air.

The length or height, of the yarn per tuft is controlled by a servo-motor 52 and tachometer 53, the servo-motor 52 driving the yarn feed roller 51 and thus pulling the yarn through the opening 47. The servo-motor 52 receives signals, by means not shown, both from an information store (not shown) and from a tape control (not shown) so that the yarn feed roller 51 is driven at a speed such as to produce a controlled continuously variable pile height, a constant pile height, or a pile height changing in steps, whichever is required. The tachometer 53 senses the value of the actual speed of the servo-motor 52 and this value is compared (by means not shown) with a pre-set value in order to produce the signals transmitted to the servo-motor 52.

A gear 55 is fixed to a cylindrical member 56 which is rotatably mounted in the frame 46 by means of bearings 60, 61. The hollow shaft 34 has a portion of its outer periphery which is square in cross-section and which extends slidably through a square cross-section sleeve 57, the sleeve 57 being mounted within a square cross-section hole in the cylindrical member 56 and engaging the latter.

The arrangement is thus such that if the gear 55 is rotated clockwise (by means not shown), the hollow shaft 34, and hence the needle 26, will also be rotated clockwise, whereas if the gear 55 is rotated counter-clockwise, the needle 26 will be rotated counter-clockwise. The gear 55 may be respectively rotated clockwise and counter-clockwise from a motor shaft (not shown) by means of first and second clutches (not shown), e.g. as shown in the said co-pending Application. The gear 55, which may be programmed to be set in a plurality of predetermined angular positions, thus controls the angular position of the needle carrier shaft 34 and hence of the needle 26, the arrangement being such that throughout the movement of the said head over the said base material, the tip of the needle 26 (for the reasons explained in detail in the said co-pending application) always faces forwardly with respect to the direction of relative movement of the needle with respect to the base material.

In operation, therefore, the hollow shaft 34, which carries the needle 26, is slidingly reciprocated within the sleeve 57 by virtue of the drive from the shaft 15. When, however, appropriate signals are sent to the said first and second clutches, the cylindrical member 56 is rotated through the shortest angular distance to a different angular position, and this rotation of the cylindrical member 56 is transmitted to the needle 26 by way of the sleeve 57.

The electrical control device 24 of FIG. 1 may be formed as shown in the circuit diagram of FIG. 3. In this case, a digital to analogue converter 63 is arranged to accept from a magnetic tape or tapes a number of digital inputs encoded in such a way as to define the required operating speed (i.e. the required frequency of reciprocation) of the shaft 15 at any given time. The said digital inputs are converted by the converter 63 to produce an analogue voltage output which is passed through a filter 64 to a voltage controlled oscillator 65. The oscillator 65 is a voltage to frequency converter which controls the rate of reciprocation of the shaft 15. The filter 64 controls the rate of change of the voltage applied to the oscillator 65 so as to ensure that the rate of change of frequency of reciprocation of the shaft 15 is controlled to a predetermined value. This is required because when a change of speed is dictated by the said information store or tape control there cannot be an instantaneous change in the frequency of reciprocation of the shaft 15 because this would require an instantaneous change in the speed by the said traversing mechanism. The oscillator 65 is arranged to produce an output signal $F_o$ whose frequency is proportional to the required frequency of reciprocation of the shaft 15, the output $F_o$ being passed to a sequencer 66 which, as described in greater detail below, produces digital outputs for the coils 11, 12 respectively, so as to ensure that the latter are alternately energised. These digital outputs are respectively applied to resistor networks 70, 71 which convert the said digital outputs to analogue voltages having the required drive waveform for operating the coils 11, 12. These analogue voltages are respectively applied to power transconductance amplifiers constituted by voltage to current converters 72, 73 whose outputs are respectively passed to the coils 11, 12.

The construction of the sequencer 66 is shown in FIG. 4, while its operation is illustrated by the waveform diagram of FIG. 5. As shown in FIG. 4, the sequencer 66 comprises logic 79 which receives the output signal $F_o$ from the oscillator 65. The logic 79 also receives stop signals both from a machine control system and from a magnetic tape (programmed operating instructions).

A stop signal may occur at any time during the reciprocation of the shaft 15, and the logic 79 is therefore arranged, as described in greater detail below, to ensure that, when a stop signal occurs, movement of the shaft 15 continues until the current of the rear solenoid coil 12 had declined to a predetermined value, at which value it constitutes a holding current. At this point, therefore, the rear solenoid coil 12 will hold the shaft 15 in its rearmost position, i.e. in the position in which the needle 26 is fully retracted from the said base material, and the rear solenoid coil 12 will continue to hold the shaft 15 in the said rearmost position until the stop signal is removed.

The signal $F_o$ is transmitted from the logic 79 to a clock intput of a 4-binary counter 80. The binary counter 80 has outputs $Q_1$, $Q_2$, $Q_3$, $Q_4$ which are respectively connected to inputs $I_1$, $I_2$, $I_3$ and to a select input of a demultiplexer 81. The demultiplexer 81 has outputs $A_1$, $A_2$, $A_3$ which are connected to the resistor network 71 of the forward solenoid coil 11, and outputs $B_1$, $B_2$, and $B_3$ which are connected to the resistor network 70 of the rear solenoid coil 12. By reason of the connection of the highest order output $Q_4$ of the binary counter 80 to the select input of the demultiplexer 81, the inputs $I_1$, $I_2$, $I_3$ are alternately connected to the outputs $A_1$, $A_2$, $A_3$ and to the outputs $B_1$, $B_2$, $B_3$ so as to ensure alternate energisation of the coils 11, 12, whereby to effect reciprocation of the shaft 15.

The four output lines of the binary counter 80 are also connected to inputs A, B, C, D of a decoder 82 which has an output Q which is connected to the logic 79. The decoder 82 generates an output signal from Q whenever the input to the decoder 82 from the binary counter 80 has the same value as that of the holding current when applied to the rear solenoid coil 12.

As will be seen from FIG. 5, during each normal reciprocation of the shaft 15 there will be a brief period during which the decoder 82 will transmit an output signal to the logic 79, but this will not affect the manner in which the shaft 15 is being reciprocated nor will it stop such reciprocation. The logic 79 is such, however, that if the stop signal goes high, that is to say if the machine control system or the magnetic tape produces a stop signal, the signal $F_o$ continues to be applied to the clock input of the binary counter 80 until the output from the decoder 82 goes high. The clock is then gated off, with the result that the rear solenoid 12 is maintained energised by its holding current.

When, however, the stop signal goes low, i.e. when the stop signal from the machine control system or the magnetic tape is removed, the signal $F_o$ is restored to the binary counter 80 irrespective of the state of the decoder 82. Thus the reciprocation of the shaft 15 then continues.

The reciprocation of the needle 26 by the solenoid drive shown in FIG. 1 has substantial advantages. In particular it makes it possible to ensure that the needle 26 will always be stopped in a position in which it is fully retracted from the base material whenever the operation of the said head is started or stopped. It can therefore be arranged that the needle will always make a complete stroke during both the first and the last of the stitches which the needle makes throughout the time that the head is moving. This means that both the first and the last stitches will pass properly through the base material and will therefore be of good quality. Moreover, it is possible to work out exactly how many whole stitches are to be effected during a predetermined traverse of the head, and by appropriate adjustment of the rate of reciprocation of the needle, it is possible to ensure that exactly this number of whole stitches are produced in practice.

The control of the stitches in this way is important for pattern definition and the the elimination of faulty stitches at the start and end of a row of stitches. It is also important to have such a precise control of the number of stitches when the pattern requires the row of stitches to make a large angle turn, for example, a right angle. In this case, in order to obtain good pattern definition, it is necessary to control the position of the individual stitches at the "corner". This can easily be achieved by arranging that an appropriate number of whole stitches are made from a given starting point. Moreover, pattern features based on changes in pile height can be programmed so that the or each such change in pile height occurs at a predetermined stitch.

Additionally, the said solenoid drive allows the needle 26 to be reciprocated at a variable rate by means of electrical signals, such signals having a short response time and not requiring feed-back.

The solenoid drive also eliminates the need for mechanical arrangements such as cams and crank motions, it enables the stroke to be changed by a simple modification of the parts of the solenoid drive, it is easily associated with electronic control systems, and it provides improved control of the needle reciprocation together with simplicity of manufacture.

The solenoid drive can be operated to provide a constant speed of penetration of the needle 26 into the base material, this constant speed of penetration being independent of the stitching rate. This improves the stitching performance during slow speeds of the said head. Thus the machine can be programmed to effect slow speed when starting, stopping, and when turning large angle corners, e.g. of 90°, the maintenance of a constant penetration speed ensuring that the needle penetrates the fabric adequately at all times.

The stop signals which effect stopping of the reciprocation of the needle may arise as a result of a fault, e.g. a yarn break, during operation of the machine. If such a fault occurs, the needle will not be stopped until it is fully retracted from the base material, and consequently the fault can be rectified and the machine restarted without the loss of pattern or product quality.

Although in the description above the needle can be stopped only at the end of its reciprocation when it is fully retracted from the base material, it can if desired additionally be arranged to be capable of being stopped at each end of its reciprocation. Moreover, the stopped time at the end of each forward and reverse stroke may be variable.

The provision of the solenoid drive concentrically of the needle carrier shaft, or of a shaft which drives the needle carrier shaft, enables the latter to be rotated in either angular direction simultaneously with its being reciprocated. The construction of the solenoid drive need not, however, be symmetrical, that is to say the coils, current and waveform used to effect movement of the needle carrier shaft in one linear direction need not be the same as those used to effect movement of the needle carrier shaft in the opposite linear direction.

When it is necessary to change the speed of reciprocation of the needle, the solenoid drive provides a very accurate control of both the frequency of reciprocation and the rate of change of the frequency of reciprocation of the needle. This is a very important feature in a fully automated machine which is timed in dependence upon the speed of reciprocation of the needle.

In the construction shown in FIG. 2, at each change of direction of the relative movement between the needle and the base material, the needle carrier shaft 34 is rotated so that the tip of the needle 26 always faces forwardly. In certain circumstances, however, such rotation of the needle is not necessary. For example, if a fine or thin yarn is used, since the diameter of the yarn will be small in comparison with the diameter of the needle, the needle can deflect the yarn away from the point at which the needle is about to penetrate the fabric, and consequently it may not be necessary to arrange that the needle is pointing in any particular direction. In this case, the shaft 15, can be made hollow so that a yarn or yarns may be passed therethrough, the shaft 15 being integral with a needle 62, as illustrated diagrammatically in FIG. 1. The needle 62 will in this case be merely reciprocated into and out of the base material (not shown) but will not be capable of being rotated.

Alternatively, the shaft 15 may be made hollow and the yarn passed therethrough to the needle 62, the latter being rotated at predetermined times by a stepper motor drive as shown in our said co-pending patent application.

In the machine illustrated in the drawings, only one needle is employed and the mechanism is, in operation, disposed on one side only of the base material to which the yarn or yarns are being applied. However, the present invention is applicable to the manufacture of textile products which require mechanism on opposite sides of the base material. For example, the present invention is applicable not merely to a machine which produces a tufted fabric by the method discussed above, but equally to a known machine for producing a tufted fabric which incorporates a looper (not shown). Such a looper is disposed on the side of the base material opposite that to which the needle 26 is retracted, the looper being arranged to reciprocate parallel to the base material and into and out of engagement with each newly formed loop so as to assist in its formation. If the invention is applied to such a machine, it is necessary to rotate the looper as required to the same angular position as the needle, while it is also necessary to rotate the needle to ensure that the plane of the needle always lies in the direction of the traverse of the needle and thus faces forwardly.

The present invention is also applicable to a known machine which produces cut pile tufting and which in addition to the said looper, is also provided on the side of the base material remote from that to which the needle is retracted, with a knife which reciprocates towards and away from the base material and thus towards and away from a position in which it cuts a loop or loops held by the looper. If the invention is applied to such a machine, it is necessary to rotate both the looper and the knife to the same angular position as the needle, while it is also necessary to rotate the needle to ensure that the plane of the needle always lies in the direction of the traverse of the needle and thus faces forwardly.

The invention is applicable to the production of textile fabrics of all kinds, e.g. woven fabrics, knitted fabrics, needled fabrics and spun bonded fabrics.

The needle employed in the present invention, instead of being used to effect tufting, may be used to effect sewing, e.g. the stitching of two or more fabrics together, or may be used to effect embroidery, e.g. the stitching of a decorative yarn onto a base fabric.

Such sewing or embroidery may involve the use of needles on opposite sides of the base material, each such needle being rotated when necessary to ensure that its leading end is always correctly disposed.

Alternatively, the stitches may be "chain" stitches which use only one yarn or thread, the mechanism involving the use of a reciprocating "gripper hook" or "looper" on the opposite side of the fabric to that to which the needle is retracted.

If, however, a "lock stitch" is required, two yarns are used. In this case the needle 26 may be used to take one yarn through the base material to form a loop, while a shuttle (not shown) may be employed to take a second yarn through this loop. A rotary hook mechanism can be used for this purpose, and in this case the loop of yarn from the needle is taken by the hook around a bobbin case, to enclose the second yarn as the latter is unwound from the bobbon.

The tufting and sewing methods discussed above require that the mechanisms disposed on opposite sides of the base material operate in timed sequence in relation to each other. In conventional machines the mechanisms are provided with a common mechanical drive but this imposes a severe restriction on the design of such machines. If, however, the mechanisms on opposite sides of the base material are both driven by a solenoid drive as shown in FIG. 1, the timing and associated controls can be remotely mounted and require only electrical connections. The electronic control of the voltages applied to the solenoid coils 11, 12 can also provide a remote timing function for an electrical drive for those parts of the stitching mechanism operating on the opposite side of the base material.

We claim:

1. A machine for making a textile product comprising a needle carrier shaft, a magnetically permeable core member which is mounted for reciprocating movement and which is drivingly connected to said needle carrier shaft to effect reciprocation of the latter, yarn feeding means for feeding a yarn to a needle carried by said shaft, two electromagnetic devices which are respectively disposed on opposite sides of the core member to effect reciprocation thereof, and an electrical control device which, on receiving a stop signal from a machine instructions means, permits reciprocation of the needle carrier shaft to continue until the latter is at the said end of its reciprocation when a holding current from said electrical control device is passed to the respective electromagnetic device to hold the needle carrier shaft at the said end of its reciprocation.

2. A machine as claimed in claim 1 in which the needle carrier shaft is arranged to be set in a plurality of predetermined angular positions, the control device being arranged to be programmed to rotate the said needle carrier shaft to the said predetermined angular positions.

3. A machine for making a textile product comprising a needle carrier shaft, a magnetically permeable core member which is mounted for reciprocating movement and which is drivingly connected to said needle carrier shaft to effect reciprocation of the latter, yarn feeding means for feeding a yarn to a needle carried by said shaft, two electromagnetic devices which are respectively disposed on opposite sides of the core member to effect reciprocation thereof, and an electrical control device for controlling reciprocation of the needle carrier shaft, the electrical control device comprising signal receiving means for receiving programmed signals indicative of different required frequencies of reciprocation of the needle carrier shaft at different times, and output means which are connected to the signal receiving means and to the electro-magnetic devices for alternately energizing the latter so that the rate of change of frequency of reciprocation of the needle carrier shaft is controlled to a predetermined value, the output means, on receiving a stop signal from a machine instructions means, permits reciprocation of the needle carrier shaft to continue until the latter is at the said end of its reciprocation when a holding current from said electrical control device is passed to the respective electro-magnetic device to hold the needle carrier shaft at the said end of its reciprocation.

* * * * *